United States Patent [19]

Dooley

[11] 4,334,649

[45] Jun. 15, 1982

[54] APPARATUS FOR MANIPULATING A SPRAY HEAD OF A SPRAY GUN

[76] Inventor: Richard A. Dooley, 400 S. Westwood Ave., Toledo, Ohio 43609

[21] Appl. No.: 141,298

[22] Filed: Apr. 18, 1980

[51] Int. Cl.[3] ..... B05B 15/08

[52] U.S. Cl. ..... 239/587; 74/89.15

[58] Field of Search ..... 74/89.15, 127, 57-59; 239/184, 186, 225, 264, 265, 301, 587, 588

[56] References Cited

U.S. PATENT DOCUMENTS

| | | | |
|---|---|---|---|
| 513,167 | 1/1894 | Woodhouse | 239/587 X |
| 562,819 | 6/1896 | Gifford | 239/301 |
| 4,125,035 | 11/1978 | Dooley | 239/264 X |

*Primary Examiner*—Andres Kashnikow

*Attorney, Agent, or Firm*—Allen D. Gutchess, Jr.

[57] ABSTRACT

Apparatus is provided for rotating the spray head or cap of a spray gun to manipulate a noncircular spray emitted therefrom relative to a workpiece to be coated. The apparatus includes a translator located adjacent the spray gun cap and having a drive gear meshing with a driven gear on the cap. The translator includes a twist drill and carrier block moveable longitudinally and having pins extending into helical grooves of the drill. The translator forms a noncircular passage and the block is noncircular so as to be held in the passage for longitudinal but nonrotatable movement. When the block and pins move longitudinally they cause the drill and the drive gear which is affixed thereto to rotate. A flexible, tubular plastic shaft and a flexible plastic tubular sheath extend from the translator to a remote position where a suitable drive moves the shaft longitudinally to move the block. The sheath and shaft are highly flexible and light in weight.

7 Claims, 4 Drawing Figures

APPARATUS FOR MANIPULATING A SPRAY HEAD OF A SPRAY GUN

This invention relates to apparatus for manipulating a spray head or cap of a spray gun to change the orientation of a noncircular spray emitted therefrom.

The apparatus is designed to be used with a spray gun which is manipulated in predetermined motions adjacent a conveyor along which workpieces to be coated are carried. The spray gun can be located in a spray booth through which the pieces to be painted are moved along a given path. The spray gun is controlled automatically through motions coordinated with the workpieces to coat them without the use of any operator whatsoever. Further, the coating can be accomplished faster and more accurately with greater uniformity and less paint than when the spray gun is manually controlled.

In my U.S. Pat. No. 3,827,309, a rectangular frame, in a preferred form, is shown which has parallel opposite frame members with a mounting member on which the spray gun is mounted being manipulated within the area of the frame and in paths parallel to the plane of the frame. Mutually perpendicular, elongate supporting rods extend between opposite frame members and cross one another with the mounting member on which the spray gun is mounted being slidably supported on the crossing portions of the two rods. The elongate rods are moved transversely in directions parallel to the frame members between which they extend. This movement is accomplished by rack and pinion mechanisms within the frame members. Each mechanism includes a moveable gear rack and a stationary gear rack engaged by two pinions having different numbers of teeth. This arrangement enables the supporting member to move rapidly across the frame and yet provides excellent accuracy insofar as the positioning of the elongate supporting rods and the spray gun is concerned.

In my U.S. Pat. No. 4,125,035, the spray gun is connected to the mounting member in a manner to provide several additional motions. The connecting arrangement includes means for moving the spray gun in a direction which is perpendicular to the plane of the frame to move the spray gun toward and away from the workpiece. The connecting arrangement also enables pivotal movement of the spray gun about a first axis which is parallel to the plane of the frame and also about a second axis which is perpendicular to the first axis but also parallel to the plane of the frame. The connecting arrangement also enables the spray head of the spray gun or the entire spray gun to pivotally move or rotate about a third axis which is perpendicular to one of the latter two axes.

The present invention provides improved apparatus for rotating the spray head or cap of the spray gun to change the orientation of a noncircular spray emitted therefrom. The new apparatus includes a translator mounted adjacent the spray gun and connected directly to a drive member or gear which rotates a driven member or gear located on the spray gun head or cap. The translator includes a housing having a noncircular passage therethrough with an elongate member or twist drill rotatably carried by said housing. One end of the twist drill is affixed to the drive gear to cause it to rotate when the twist drill is rotated. A longitudinally-moveable member or carrier block has a noncircular outer surface which is of a shape similar to that of the housing passage and is longitudinally moveable in the passage, but the noncircular shapes prevent the block from rotating relative to the housing. The noncircular shape of the housing and block substantially reduce machining operations and costs which were incurred in the translator of the U.S. Pat. No. 4,125,035. The block has projections or pins which are received in helical grooves in the twist drill, causing the twist drill to rotate along with the drive gear when the block is moved along longitudinally. A flexible tubular plastic shaft has an end connected to the block with a flexible tubular plastic sheath located around most of the length of the shaft. Suitably remotely located means, such as a fluid-operated cylinder, is connected to the other end of the shaft to cause it to move longitudinally and move the block.

With the translator located adjacent the spray gun, rather than at a remotely located position, more effective control over the rotation of the spray gun cap can be obtained. Also, slight but unwanted rotational movement of the spray gun cap when the spray gun is moved about other axes is also eliminated or substantially reduced. The new plastic shaft and sheath are also much lighter in weight and substantially more flexible than the metal cables heretofore employed. The translator is also substantially shorter than that of my U.S. Pat. No. 4,125,035.

It is, therefore, a principal object of the invention to provide improved means for rotating a spray gun cap having the advantages set forth above.

Another object of the invention is to provide mechanism for rotating a spray gun cap which includes a highly flexible plastic shaft with a plastic sheath therearound.

Yet another object of the invention is to provide mechanism for rotating a spray gun cap which includes a translator mounted adjacent the spray gun.

A further object of the invention is to provide a translator for rotating a spray gun cap which includes a housing and a longitudinally moveable block therein which are of cooperating, noncircular shape.

Many other objects and advantages of the invention will be apparent from the following detailed description of a preferred embodiment thereof, reference being made to the accompanying drawings, in which.

Figure 1:
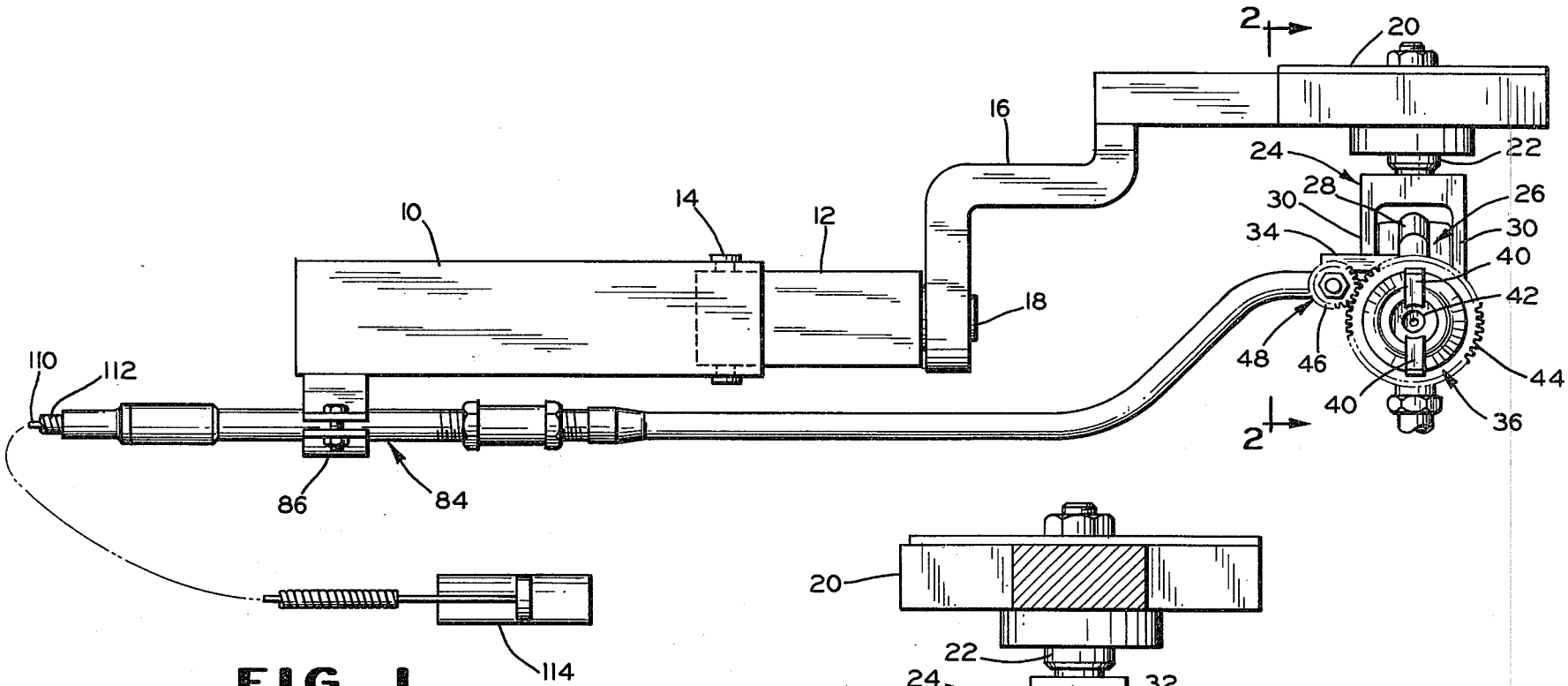
FIG. 1 is a somewhat schematic front view in elevation of a spray gun, supporting arms, and spray gun cap with rotating means in accordance with the invention.
Figure 2:
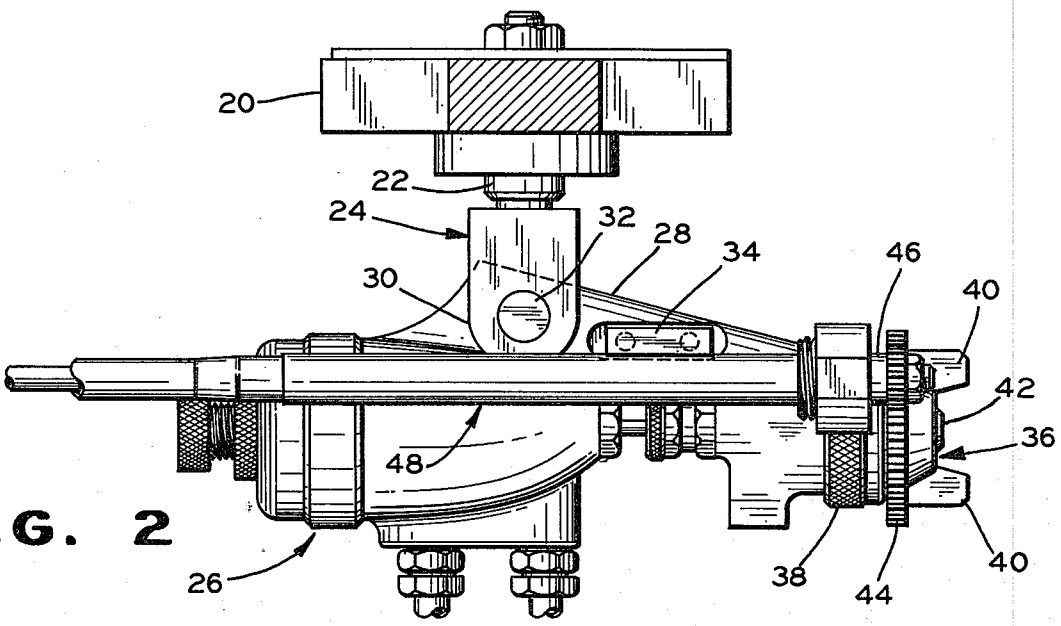
FIG. 2 is an enlarged side view in elevation, taken along the line 2—2 of FIG. 1, of the spray gun and part of the spray gun cap rotating mechanism.

Referring to FIG. 1, a spray gun and manipulating apparatus as shown includes an arm 10 which is pivotally connected at its left end to another arm (not shown) which is supported by the mounting member located in the plane of the rectangular frame disclosed in my aforementioned two patents. A shorter arm 12 is pivotally connected through a pin 14 to the right end of the arm 10 and, through appropriate linkages (not shown), maintains the spray gun in a constant orientation as it is moved toward and away from the rectangular frame through the arm 10 and the other arms. A bracket 16 is pivotally connected by a pin 18 to the end of the short arm 12 to enable the spray gun to pivot about a horizontal axis which is parallel to the plane of the rectangular frame. A gear box 20 is pivotally connected through a pin or shaft 22 to a spray gun support 24 to turn the spray gun support and a spray gun 26 carried thereby on a vertical axis which is perpendicular to the horizontal axis and is also parallel to the plane of the rectangular frame.

The spray gun 26 held by the support 24 is basically a commercially-available one. It has an upper flange 28 which is connected to legs 30 of the support 24 through a fastener 32. A side support 34 also extends outwardly from the flange 28, being affixed at its end by two fasteners, such as screws. A spray head or cap 36 is rotatably mounted on the spray gun through a nut 38 by suitable means such as a snap ring, as shown in my U.S. Pat. No. 4,125,035. The cap 36 has conventional air horns 40 which cause the spray pattern emitted from a nozzle 42 to assume a noncircular shape, usually elliptical. A driven member or ring gear 44 is located on the cap 36 and can be formed structurally integral therewith. A drive member or spur gear 46 meshes with the gear 44 and causes it and the spray cap 36 to rotate when the drive gear 46 is driven.

Figure 3:
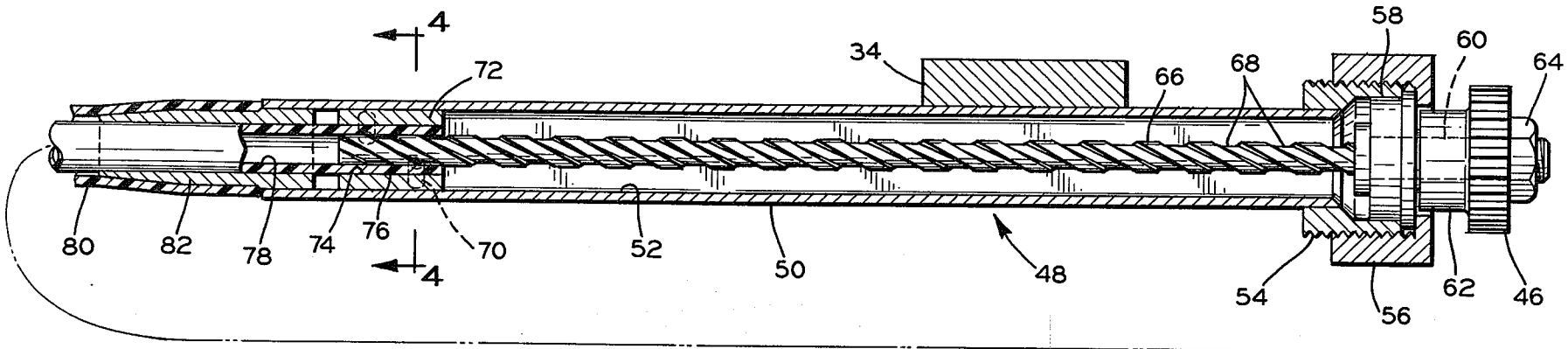
FIG. 3 is a further enlarged view in longitudinal cross section of part of the spray gun cap rotating mechanism.
Figure 3:
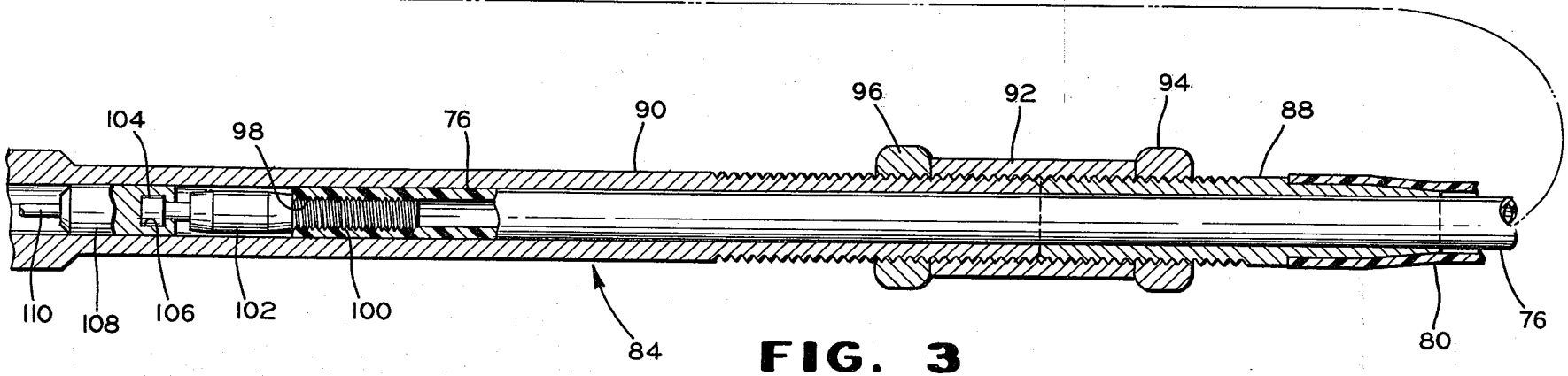

Referring to FIG. 3, the drive gear 46 is located at an end of a translator 48 which converts longitudinal motion to rotary motion. The translator 48 includes a housing 50 which is affixed to the side support 34, as by silver solder. The housing 50 forms a noncircular, in this case substantially square, passage 52 extending therethrough. An end of the housing 50 has a threaded enlarged block affixed thereto, as by silver solder, and a nut 56 is threaded on the block 54. A flanged bearing 58 is held by the block 54 and the nut 56 and, in turn, rotatably supports a flanged sleeve 60. A hub 62 of the gear 46 is mounted on the sleeve 60 for rotation therewith by a nut 64. The inner end of the sleeve 60 is affixed to an end portion of an elongate member or twist drill 66 by suitable means, such as by a press fit and braze metal. The twist drill 66 has two helical grooves 68 extending substantially the length thereof with the twist drill extending through most of the length of the passage 52.

Figure 4:
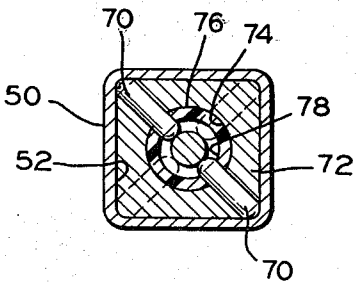
FIG. 4 is a view in transverse cross section taken along the line 4—4 of FIG. 3.

Two pair of pins 70 (FIG. 4) are spaced longitudinally with the pins of each pair being diametrically opposite and with the ends extending into the grooves 68. Only one pin need be employed although at least two are desired for symmetry. The pins 70 are carried by a noncircular carrier block 72, the outer shape of which is substantially square, being similar to the shape of the passage 52. The block thus can move longitudinally in the passage 52 but is prevented from rotating relative thereto. This eliminates the necessity of machining grooves in the members as was done in the translator of my U.S. Pat. No. 4,125,035. The block 72 has a central bore 74 therein which receives an end portion of a flexible, push-pull plastic, shaft 76. The shaft 76 has a tight fit in the bore 74 and is further held in the block 72 by the pins 70 which extend through the wall of the shaft 76. The shaft 76 has a central passage 78 into which the twist drill 66 extends when the block 76 is moved longitudinally in the passage 52 of the housing 50. In this manner the drill helps stiffen the plastic shaft. As the block 72 moves longitudinally, the cooperation of the pins 70 and the helical grooves 68 cause the drill 66 to rotate. The drive gear 46 thus also rotates and rotates the spray head through the driven gear 44 to change the orientation of the noncircular spray.

The flexible shaft 76 extends from the end of the housing 50 opposite the gear 46 where it is surrounded by a closely fitting flexible plastic sheath or sleeve 80 having an end connected to a nipple 82 which can be silver soldered to the housing 50. The sheath 80 serves as a reaction element and the shaft 76 serves as an action element in a Bowden cable-type push-pull drive. With the flexible shaft 76, the effective length of the translator 48 is only slightly more than the length of the drill 66, regardless of the position of the carrier block 72 therein. By way of example, the shaft 76 and the sheath 80 are of nylon with the shaft having a quarter inch outer diameter with a wall thickness of 0.040 inch and the sheath 80 having a three eighths inch outer diameter with a wall thickness of 0.050 inch, providing an inner diameter of 0.275 inch.

The plastic push-pull shaft 76 and the flexible sheath 80 are light in weight and highly flexible so as to have minimal effect on the motion of the spray gun 26 about its various axes. In addition, slight but unwanted rotational movement of the spray gun cap when the spray gun is moved about the various axes is also substantially eliminated or reduced.

The shaft 76 is moved longitudinally to move the block 72 to rotate the gear 46. In this instance, the shaft 76 and the sheath 80 extend to a coupling 84 which can be mounted on the arm 10 (FIG. 1) by a suitable bracket 86. The coupling 84 includes a threaded nipple 88 on which the sleeve 80 is received. The coupling also has a housing 90 with a threaded end connected to the nipple 88 by a threaded sleeve 92 and jam nuts 94 and 96. The flexible shaft 76 extends into the housing 90 and has an inner end portion 98 threaded to receive a threaded shank 100 of a connecting fitting 102. The fitting 102 has an enlarged tang 104 which is received in a transverse T-shaped slot 106 of a connector 108. The connector 108 is affixed to a Bowden cable or flexible metal shaft 110 surrounded by a sheath 112. These extend to a more remote location where the shaft 110 is moved longitudinally by suitable means, such as a fluid-operated ram 114 shown schematically in FIG. 1.

Various modifications of the above described embodiment of the invention will be apparent to those skilled in the art, and it is to be understood that such modifications can be made without departing from the scope of the invention, if they are within the spirit and the tenor of the accompanying claims.

I claim:

1. Apparatus for manipulating the spray from a spray gun relative to a workpiece, said apparatus comprising a spray head, means for supporting said spray head for rotatable movement about a central axis, said spray head having means for emitting a spray of coating material in a noncircular pattern, and means for rotating said spray head about the central axis, said rotating means, comprising driven means connected to said spray head and rotatable therewith, rotatable drive means rotatably supported near said spray head for rotating said driven means when said rotatable drive means is rotated, and means for rotating said rotatable drive means comprising a housing mounted on said spray gun and moveable therewith, a rotatable elongate member rotatably carried by said housing and connected to said rotatable drive means, a longitudinally moveable member slidably carried by said housing and having means engagable with said elongate member to cause said elongate member to rotate when said longitudinally moveable member moves longitudinally, a flexible tubular shaft extending at least partly through said longitudinally-moveable member and received over said elongate member as said shaft and said longitudinally-moveable member move in said housing toward said rotatable drive means, and remotely located means for moving said flexible shaft longitudinally.

2. Apparatus according to claim 1 characterized by said housing having a noncircular passage, with said longitudinally moveable member having noncircular shape and being slidably mounted in said passage for longitudinal movement but nonrotatable movement with respect thereto.

3. Apparatus according to claim 1 characterized by said engageable means of said longitudinally-moveable member comprising a projection held by said longitudinally-moveable member, extending through said flexible tubular shaft, and received in a helical groove of said rotatable elongate member.

4. Apparatus for manipulating the spray from a spray gun relative to a workpiece, said apparatus comprising a spray head, means for supporting said spray head for rotatable movement about a central axis, said spray head having means for emitting a spray of coating material in a noncircular pattern, and means for rotating said spray head about the central axis, said rotating means comprising driven means connected to said spray head and rotatable therewith, rotatable drive means for rotating said driven means when said rotatable drive means is rotated, and means for rotating said rotatable drive means comprising a translator, said translator having a housing, means mounting said housing on the spray gun, a rotatable elongate member rotatably carried by said housing, said housing having a longitudinally-extending passage which is of noncircular shape in transverse cross section, means connecting said elongate member and said drive member to cause said drive member to rotate with said elongate member, and a longitudinally moveable member having a noncircular shape similar to the transverse cross-sectional shape of said passage, said longitudinally moveable member being slidably carried in said passage for slidable but nonrotatable movement with respect thereto, said longitudinally-moveable member having means engagable with said elongate member to cause said elongate member to rotate when said longitudinally-moveable member is moved longitudinally, a flexible plastic shaft having an end connected to said longitudinally-moveable member, a flexible plastic sheath around a substantial portion of the length of said shaft, and remote drive means for moving said flexible shaft to longitudinally move said longitudinally-moveable member.

5. Apparatus according to claim 4 characterized by said flexible shaft being tubular, said longitudinally-moveable member being a carrier block having a central bore through which said elongate member extends, said bore also receiving said flexible plastic shaft, said carrier block having at least one projection which extends through a wall of said shaft and into a helical groove in said elongate member.

6. Apparatus for manipulating the spray from a spray gun relative to a workpiece, said apparatus comprising a spray head, means for supporting said spray head for rotatable movement about a central axis, said spray head having means for emitting a spray of coating material in a noncircular pattern, and means for rotating said spray head about the central axis, said rotating means comprising driven means connected to said spray head and rotatable therewith, rotatable drive means for rotating said driven means when said rotatable drive means is rotated, and means for rotating said rotatable drive means comprising a translator, said translator having a housing, a rotatable elongate member rotatably carried by said housing, said housing having a longitudinally-extending passage which is of noncircular shape in transverse cross section, means connecting said elongate member and said driven member to cause said drive member to rotate with said elongate member, and a longitudinally moveable member having a noncircular shape similar to the transverse cross-sectional shape of said passage, said longitudinally moveable member being slidably carried in said passage for slidable but nonrotatable movement with respect thereto, said longitudinally-moveable member having means engagable with said elongate member to cause said elongate member to rotate when said longitudinally-moveable member is moved longitudinally, a flexible tubular shaft extending into said longitudinally-moveable member and received over said elongate member as said shaft and said longitudinally-moveable member move along said passage toward said rotatable drive means, and said engageable means being a projection held by said longitudinally-moveable member and extending through a wall of said flexible tubular shaft.

7. Apparatus according to claim 6 characterized by said housing being mounted on said spray gun.

* * * * *